US008702012B2

(12) United States Patent
Arote et al.

(10) Patent No.: US 8,702,012 B2
(45) Date of Patent: Apr. 22, 2014

(54) SYSTEM FOR MAINTAINING HUMIDITY IN EXISTING AIR CONDITIONING AND HEATING UNITS

(76) Inventors: Richard Arote, Hewlett Harbor, NY (US); Nick Cotumaccio, West Islip, NY (US)

( * ) Notice: Subject to any disclaimer, the term of this patent is extended or adjusted under 35 U.S.C. 154(b) by 1586 days.

(21) Appl. No.: 12/025,136

(22) Filed: Feb. 4, 2008

(65) Prior Publication Data

US 2009/0084861 A1 Apr. 2, 2009

Related U.S. Application Data

(60) Provisional application No. 60/976,011, filed on Sep. 28, 2007.

(51) Int. Cl.
*F24F 3/14* (2006.01)

(52) U.S. Cl.
USPC ..... 236/44 A; 62/176.4; 236/44 B; 236/44 C

(58) Field of Classification Search
CPC ..... F24F 3/14; F24F 3/1411; F24F 3/1417; F24F 6/12; F24F 6/14; F24F 6/18; F24F 11/0015; G05D 22/02
USPC ..... 62/176.1, 176.4, 176.6; 236/44 A, 44 B, 236/44 C
See application file for complete search history.

(56) References Cited

U.S. PATENT DOCUMENTS

| | | | | |
|---|---|---|---|---|
| 1,781,515 | A | 3/1928 | Lewis | |
| 2,123,742 | A * | 7/1938 | Offen | 62/91 |
| 2,637,532 | A | 5/1953 | Baker | |
| 2,810,381 | A | 10/1957 | Knight | |
| 3,096,817 | A | 4/1960 | McKenna | |
| 3,169,575 | A | 2/1965 | Engalitcheff, Jr. et al. | |
| 3,623,547 | A | 11/1971 | Wallans | |
| 3,640,266 | A * | 2/1972 | Ernest | 126/113 |
| 3,840,001 | A | 10/1974 | Ernest | |
| 3,877,459 | A | 4/1975 | Harvey | |
| 3,902,473 | A | 9/1975 | Yeagle | |
| 3,908,752 | A | 9/1975 | Padden | |
| 3,958,628 | A | 5/1976 | Padden | |
| 4,042,016 | A * | 8/1977 | Boochever et al. | 165/229 |
| 4,342,204 | A | 8/1982 | Melikian et al. | |
| 4,474,021 | A | 10/1984 | Harband | |

(Continued)

FOREIGN PATENT DOCUMENTS

| | | |
|---|---|---|
| JP | 62280526 | 5/1987 |
| JP | 02040430 | 2/1990 |

(Continued)

OTHER PUBLICATIONS

SKR Residential Humidifier, www.neptronic.com, product description.

*Primary Examiner* — Marc Norman
*Assistant Examiner* — Paolo Gonzalez
(74) *Attorney, Agent, or Firm* — Robert M. Schwartz

(57) ABSTRACT

A vertical heat pump has a vertical fan coil housing containing a fan, a coil, and a discharge plenum. A cavity is formed within the fan coil housing. A humidity steam generator is disposed within the cavity. A steam dispersion tube is mounted within an airstream to be generated by the fan for delivering steam via the discharge plenum. A steam transfer tube connects the steam generator to the steam dispersion tube.

6 Claims, 4 Drawing Sheets

(56) References Cited

U.S. PATENT DOCUMENTS

| | | | | |
|---|---|---|---|---|
| 4,564,746 | A | 1/1986 | Morton et al. | |
| 5,278,454 | A | 1/1994 | Strauss et al. | |
| 5,313,930 | A | 5/1994 | Kujawa et al. | |
| 5,516,466 | A | 5/1996 | Schlesch et al. | |
| 5,543,090 | A | 8/1996 | Morton et al. | |
| 5,583,301 | A | 12/1996 | Strauss et al. | |
| 5,740,790 | A | 4/1998 | Lipsky | |
| 5,744,923 | A | 4/1998 | Strauss et al. | |
| 6,027,030 | A * | 2/2000 | Buijsse | 236/44 C |
| 6,078,729 | A | 6/2000 | Kopel | |
| 6,129,285 | A | 10/2000 | Schafka | |
| 6,398,196 | B1 * | 6/2002 | Light et al. | 261/130 |
| 6,508,303 | B1 | 1/2003 | Naderer | |
| 6,725,915 | B2 | 4/2004 | Wheat et al. | |
| 6,742,582 | B1 | 6/2004 | Wheat et al. | |
| 6,792,963 | B2 | 9/2004 | Kopel | |
| 7,011,300 | B2 | 3/2006 | Kopel et al. | |
| 7,012,223 | B2 | 3/2006 | Kopel | |
| 7,155,921 | B2 | 1/2007 | Lee et al. | |
| 7,534,306 | B2 | 5/2009 | Kopel et al. | |
| 2004/0194482 | A1 * | 10/2004 | Lee et al. | 62/176.1 |
| 2005/0109764 | A1 | 5/2005 | Kopel | |
| 2005/0212152 | A1 * | 9/2005 | Reens | 261/81 |
| 2006/0016201 | A1 | 1/2006 | Kopel | |
| 2006/0081271 | A1 | 4/2006 | Kopel et al. | |
| 2008/0157409 | A1 * | 7/2008 | Reens | 261/118 |

FOREIGN PATENT DOCUMENTS

| | | |
|---|---|---|
| JP | 2006052881 | 2/2006 |
| JP | 2006052882 | 2/2006 |
| JP | 2006115782 | 5/2006 |
| JP | 2006153321 | 6/2006 |
| JP | 2006317078 | 11/2006 |

* cited by examiner

SYSTEM FOR MAINTAINING HUMIDITY IN EXISTING AIR CONDITIONING AND HEATING UNITS

INDEX TO RELATED APPLICATIONS

This application claims the benefit of U.S. Provisional Patent Application Ser. No. 60/976,011 filed Sep. 28, 2007 the disclosure of which is incorporated by reference in its entirety.

BACKGROUND OF THE INVENTION

Field of the Invention

The invention relates to air-conditioning and heating units. Specifically, to a system for maintaining humidity in air-conditioning and heating units.

BRIEF SUMMARY OF THE INVENTION

The present invention is a system for incorporating a humidifier into a vertical fan coil unit comprising:

a. mounting a humidifier on the upper section of a fan coil unit;

b. providing a fresh water inlet to said humidifier; and c. providing an outlet from said humidifier configured such that steam is incorporated into the outlet air stream of the fan coil.

The system has a humidifier and/or steam generation unit and at least one steam dispersion outlet extending from said humidifier and/or steam generation unit. The steam dispersion outlet may be steam emitting nozzles or at least one steam dispersion tube. In one embodiment, the system includes an appropriate sensor to measure ambient indoor humidity and generating steam as needed to maintain the ambient humidity between about 25-50%.

The steam generator ceases to operate if ambient humidity is over about 50% and operates if the ambient humidity drops below about 25%.

The present invention provides for a system having a humidification unit incorporated in a typical vertical fan coil or vertical heat pump. The humidifier is mounted within the existing vertical fan coil housing and will have at least one steam generator and at least one steam dispersion device. Additionally, the humidifier will have a fresh water supply as the starting material for producing steam. In one embodiment, a fresh water supply may further comprise an in-line filter such that the unit provides steam that is generally free of particulate.

The system of the present invention further comprises at least one sensor for detecting ambient humidity in the air space cooled or heated by the existing air conditioning and or heating system. The measuring of ambient humidity may be by any means currently known in the art. The transmission of information relating to the ambient humidity of a given enclosed area may be by any means currently known in the art.

When the humidity sensor detects that ambient humidity has dropped below a preset value, the system will initiate steam generation in order to raise the humidity level and start the supply fan. When the humidity Sensor detects that the ambient humidity has exceeded a preset value, the system will cease to produce steam and shut off the supply fan. Typically, indoor ambient humidity is maintained at 25% to 50% in order for most persons to feel comfortable.

The system of the present invention will incorporate a steam generation unit and a steam dispersion outlet to be mounted in the discharge duct. The steam dispersion outlet may be any acceptable outlets that will introduce steam into the outlet air flow of the existing air-conditioning or heating unit. The steam dispersion outlet may be a steam dispersion tube having one or more openings. Alternatively, the steam dispersion outlet may be one or more nozzles suitable for the delivery of steam. If nozzles are used, appropriate drain structures are in place to capture, accumulate and remove excess condensate that may develop in the nozzle region.

The system of the present invention further includes at least one outlet to drain water from the steam generation device. Although this drain may remove water in any acceptable manner, a preferred manner would be to incorporate the drain of the steam generator with the existing drain riser in the air-conditioning or heating unit to be modified.

In an alternative embodiment, steam generated from an external source may be delivered to the system of the present invention. For example, units that provide hot water on demand may be modified such that delivery of steam to the system of the present invention may be accomplished. In this embodiment, the steam dispersion will occur in the same manner as if the steam generation occurred within the existing vertical fan coil.

DETAILED DESCRIPTION OF THE PREFERRED EMBODIMENTS

Figure 1:
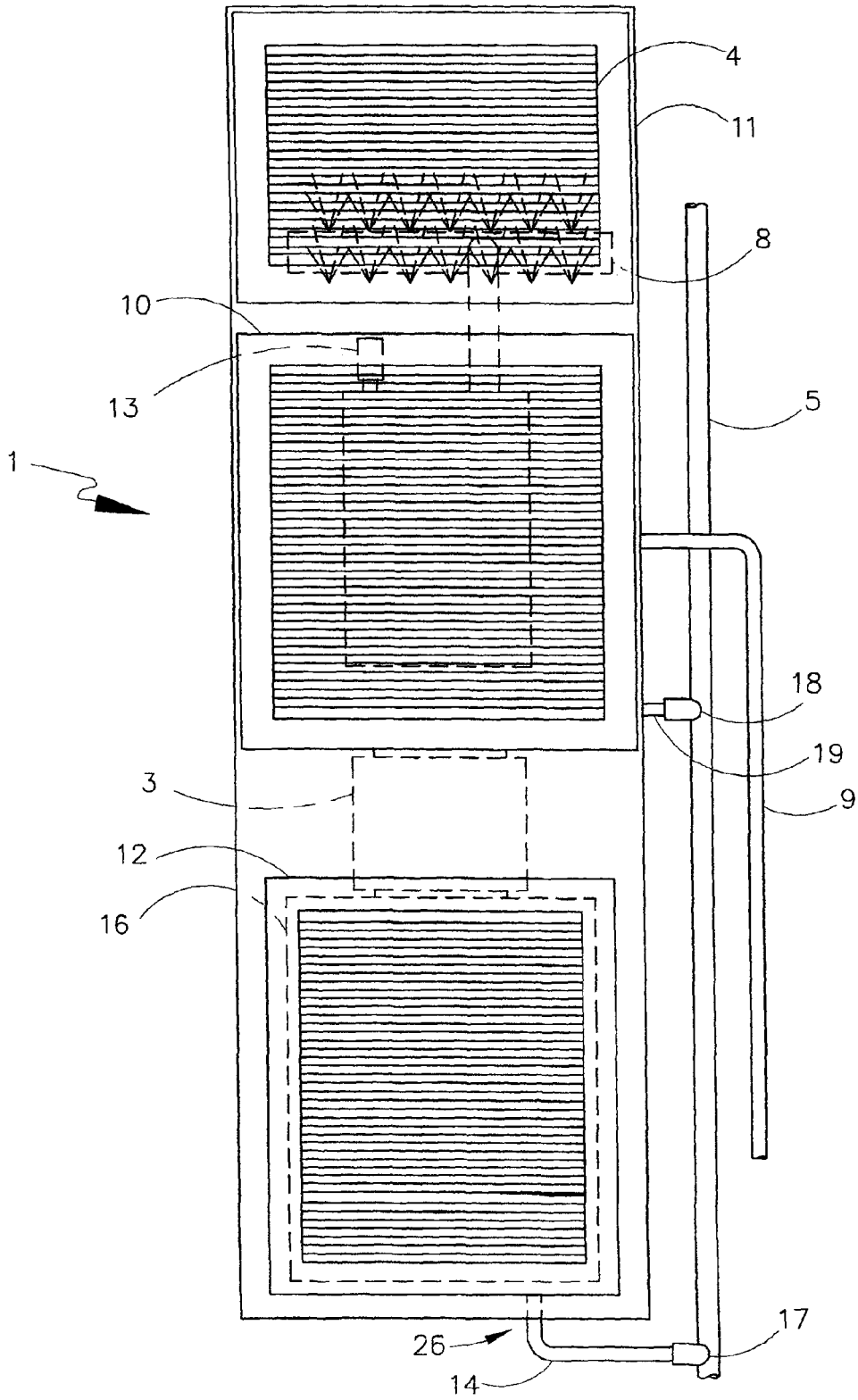
FIG. 1 is a front view of a vertical fan housing incorporating the present invention.
Figure 2:
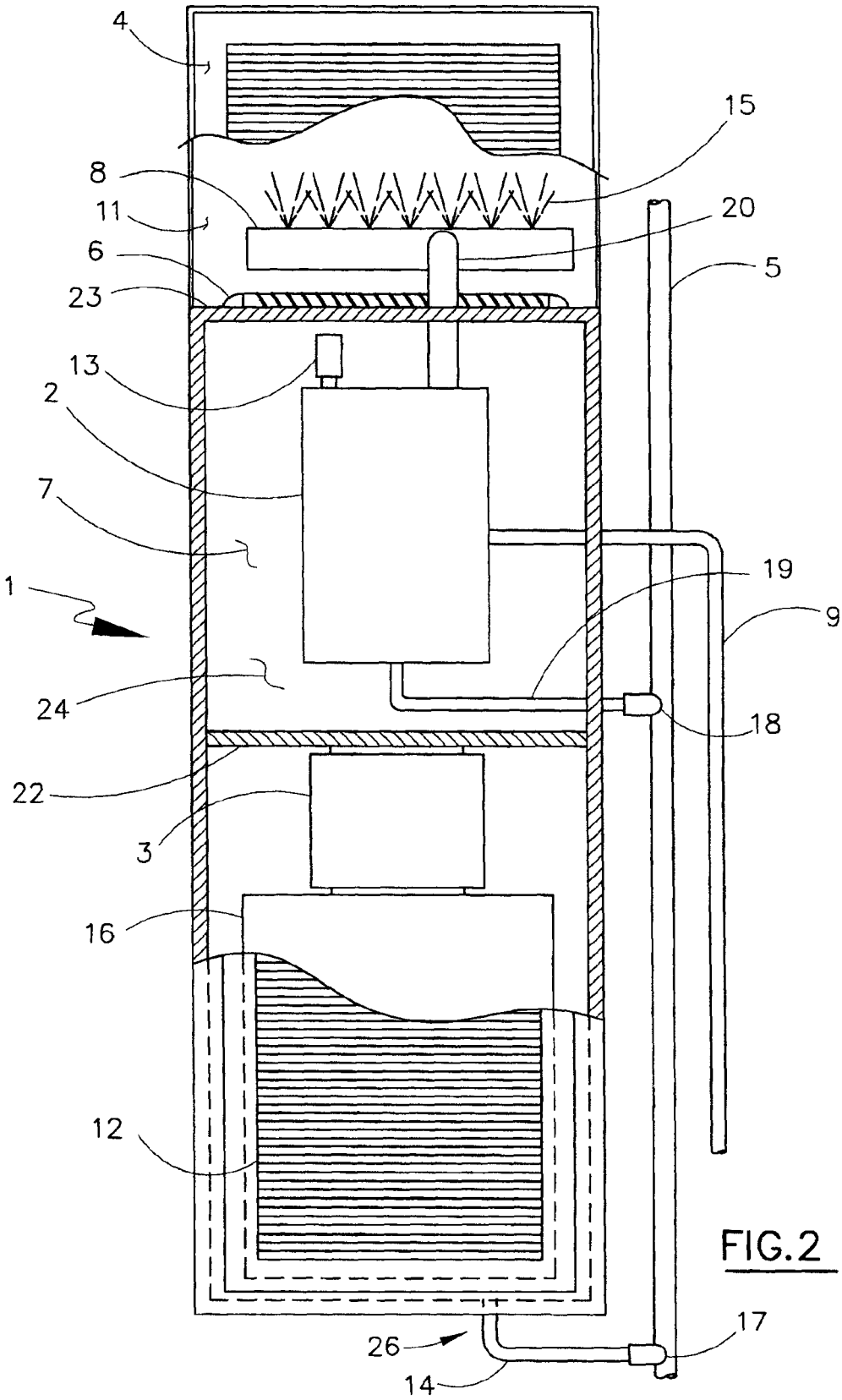
FIG. 2 is a partial cut away view of the vertical fan housing of FIG. 1.
Figure 3:
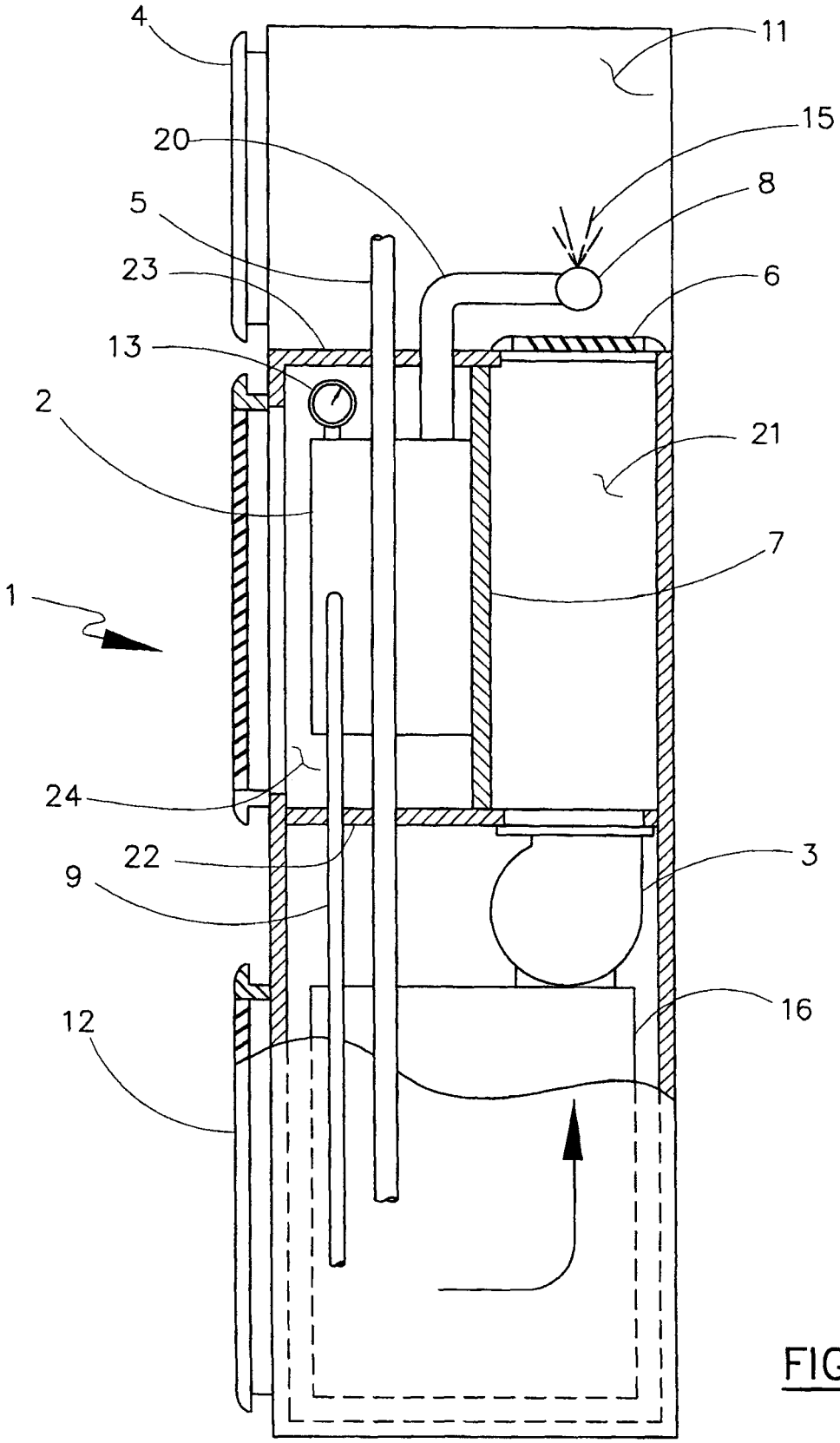
FIG. 3 is a side cut away view of the vertical fan housing of FIG. 1.
Figure 4:
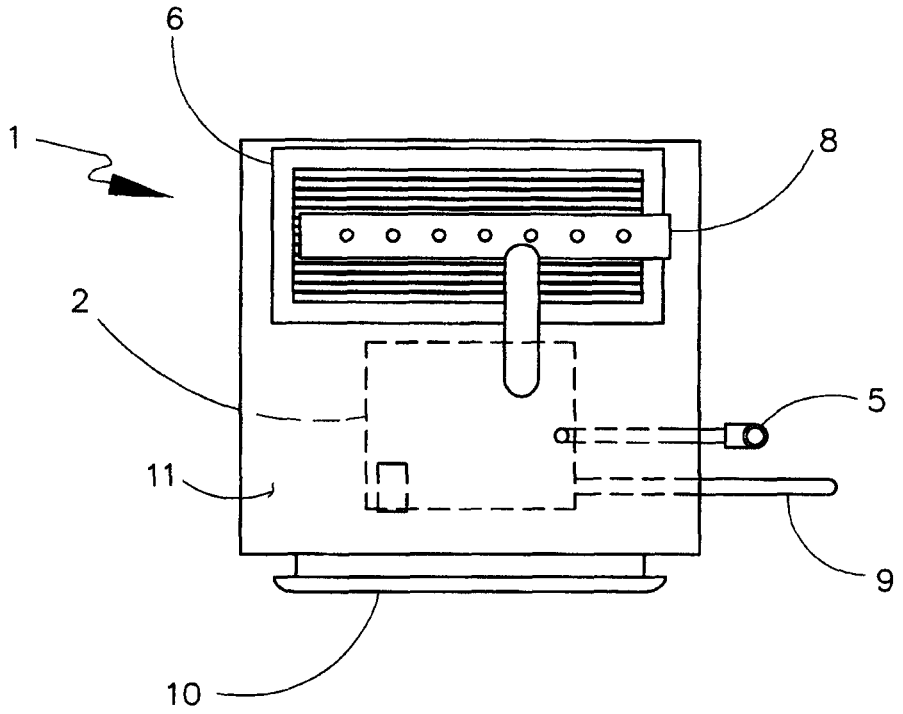
FIG. 4 is a top view of the vertical fan housing of FIG. 1.

The system of the present invention includes a vertical fan coil housing 1, modified to include a humidifier unit 2. Fan 3, is above a coil 16, which is located on the interior underneath return air grille 12.

Partition wall 7 is positioned with a partition floor 22 a partition ceiling 23 to form a humidifier cavity 24 with sides of the cavity being the sides of vertical fan coil housing 1 and a closure formed by access door 10. The cavity is an enclosure around humidifier 2, such that humidifier 2 is not in the air stream that travels through chamber 21. The air stream that enters return air grille 12 is propagated by fan 3 into chamber 21 exiting grille 6 into discharge plenum 11 and finally exiting at discharge grille 4. Humidifier 2 includes a humidity gauge 13, and a water inlet supply line 9. Optionally, the coil 16 has a drain line 14 which connects to drain riser 5 at connection 17. Humidifier drain line 19 is positioned under humidifier 2 and condensate accumulated inside humidifier 2 flows towards drain riser 5 where drain line 19 connects to drain riser 5 at humidifier drain line connector 18.

Vertical fan coil housing 1 also includes in discharge plenum 11 a steam dispersion tube 8 is mounted in discharge plenum 11 that delivers steam 15 to the air in discharge plenum 11 which combines with air exiting from chamber 21 through grille 6 and ultimately exits vertical fan coil housing 1 at discharge grille 4. Steam dispersion tube 8 is mounted in the discharge ductwork and connectively piped to the humidity steam generator 2. Drain line 14 has a drain line inlet 26 positioned near the floor of the coil 16. Accumulated water is removed by entering drain line inlet 26 of the drain line 14 and is moved from the system by the drain riser 5.

The system provides an advantageous configuration in allowing access to all components through access door 10 on the front of vertical fan coil housing 1. Steam 15 is produced within the vertical fan coil housing 1 and does not need to be transported to housing 1. Ambient air flows into vertical fan coil housing 1 through return air grille 12 passes over coil 16 and is directed by fan 3 into air flow chamber 21. Preferably, return air grille 12 is larger than discharge grille 4. The ambient air exits chamber 21 through plenum grille 6 into discharge plenum 11. Steam 15 generated within humidifier 2 is directed to steam transfer tube 20 and is dispersed into discharge plenum 11 through steam dispersion tube 8. Steam transfer tube 20 is connectively piped to steam dispersion tube 8 mounted in the discharge ductwork. In a preferred embodiment, a minimum of eighteen inches of straight ductwork above dispersion tube 8 is desired. Air traveling through chamber 21 exits plenum grille 6 and combines with steam 15 in discharge plenum 11. The mixture of air with steam exits vertical fan coil housing 1 through discharge grille 4.

Thus the unit of the present invention does not need to transport steam from outside vertical fan coil housing 1. The unit produces steam 15 within vertical fan coil housing 1 by connection of a water inlet supply line 9 to a steam generating humidifier 2 placed within housing 1. The aforementioned mixture of air with steam that exits vertical fan coil housing 1 through discharge grille 4 provides humidified air delivery through discharge grille 4.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. A vertical heat pump comprising:

a vertical fan coil housing containing a fan, a coil, and a discharge plenum;

a cavity formed within said fan coil housing;

a humidity steam generator disposed within said cavity;

a steam dispersion tube being mounted within an airstream to be generated by said fan, for delivering steam via said discharge plenum;

a steam transfer tube for connecting said steam generator to said steam dispersion tube.

2. The vertical heat pump according to claim 1, wherein said cavity is defined by a partition floor, a partition ceiling, and an access door.

3. The vertical heat pump according to claim 1, wherein said humidity steam generator has a hygrometer for detecting ambient humidity.

4. The vertical heat pump according to claim 3, wherein said hygrometer is configured to control said humidity steam generator to maintain an ambient humidity of about 25-50%.

5. The vertical heat pump according to claim 3, wherein said hygrometer is configured to shut down said humidity steam generator if ambient humidity exceeds about 50%.

6. The vertical heat pump according to claim 1, wherein said steam dispersion tube is mounted within said discharge plenum.

* * * * *